US008434548B2

(12) United States Patent
Breard et al.

(10) Patent No.: US 8,434,548 B2
(45) Date of Patent: May 7, 2013

(54) QUICK-CHANGE DRUM ASSEMBLY

(75) Inventors: Stephane Breard, Oust-Marest (FR); Dominique Aubry, Hallencourt (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 468 days.

(21) Appl. No.: 12/613,614

(22) Filed: Nov. 6, 2009

(65) Prior Publication Data

US 2011/0108289 A1 May 12, 2011

(51) Int. Cl.
*E21B 19/22* (2006.01)

(52) U.S. Cl.
USPC ..... 166/85.5; 166/77.2; 166/85.1

(58) Field of Classification Search ..... 166/77.2, 166/75.11, 85.1, 85.5
See application file for complete search history.

(56) References Cited

U.S. PATENT DOCUMENTS

| | | | | |
|---|---|---|---|---|
| 4,428,421 | A | 1/1984 | Rankin | |
| 5,015,146 | A | 5/1991 | Barnes | |
| 5,717,334 | A | 2/1998 | Vail, III | |
| 6,003,598 | A | 12/1999 | Andreychuk | |
| 6,464,012 | B1 | 10/2002 | Strickland | |
| 6,672,529 | B2 * | 1/2004 | Cain et al. | 242/394 |
| 7,036,610 | B1 | 5/2006 | Vail, III | |
| 7,331,394 | B2 | 2/2008 | Edwards | |
| 7,420,475 | B2 | 9/2008 | Adnan | |
| 7,438,280 | B2 | 10/2008 | Doud | |
| 2005/0241823 | A1 * | 11/2005 | Beato et al. | 166/243 |
| 2008/0185139 | A1 * | 8/2008 | Ives et al. | 166/77.2 |
| 2010/0314132 | A1 * | 12/2010 | Coles | 166/384 |

* cited by examiner

*Primary Examiner* — Brad Harcourt
(74) *Attorney, Agent, or Firm* — John Vereb

(57) ABSTRACT

A system for removably mounting a drum to a winch assembly comprises a drum assembly, a frame defining at least a portion of a mounting base for the drum, at least one connector for connecting the drum assembly to the mounting base, a lifting apparatus releasably attached to the drum assembly, and at least one guide member releasably attached to the frame and engaging with the lifting apparatus for directing the drum assembly away from the frame when the drum assembly is removed therefrom.

15 Claims, 5 Drawing Sheets

QUICK-CHANGE DRUM ASSEMBLY

BACKGROUND

The statements in this section merely provide background information related to the present disclosure and may not constitute prior art. The system and method relate in general to wellbore cables.

Wellbore spooled devices, such as logging cables, slickline cables, coiled tubing and the like, are typically wound upon a spool or drum to form a drum assembly and installed adjacent a wellbore for performing an operation in the wellbore such as, but not limited to, logging operations or the like. On occasion, the drum assembly may need to be changed for a different drum assembly (such as one with a longer or shorter cable or the like). This changeover may be an extremely difficult and time-consuming operation comprising a number of steps in order to disconnect the drum assembly from equipment adjacent the wellbore and maneuver the drum assembly to be in position for removal with a crane or other suitable lifting device. The changeover may be further complicated by the location of the wellbore, such as on offshore platforms, rigs, and the like and environmental conditions associated with the location of the wellbore such as, but not limited to, sea waves, wind, and cold temperatures.

In logging operations, it is not uncommon to change the drum from the logging unit few times during a job. Before being able to move the drum, numerous other systems may need to be dismounted or installed. In prior art drum assemblies, the above-mentioned components must be individually disassembled in order to allow the drum assembly to be removed from its mounting location and replaced with another drum assembly. Such individual disassembly steps may be disadvantageously time-consuming. In addition to the large number of operations to be achieved before the drum may be changed, the weight and the conditions offshore may make the operation time consuming and difficult during heavy or inclement weather.

It is desirable to improve the operation of oilfield surface equipment such as drum assemblies.

SUMMARY

An embodiment of a system for removably mounting a drum to a winch assembly comprises a drum assembly, a frame defining at least a portion of a mounting base for the drum, at least one connector for connecting the drum assembly to the mounting base, a lifting apparatus releasably attached to the drum assembly, and at least one guide member releasably attached to the frame and engaging with the lifting apparatus for directing the drum assembly away from the frame when the drum assembly is removed therefrom. The system may further comprise a conveyance spooled upon the drum. The spooled conveyance may comprise a wireline cable. The spooled conveyance may comprise coiled tubing.

The drum assembly may be releasably coupled to a prime mover. The prime mover may comprise a motor coupled to the drum assembly via a chain and sprocket connection. The motor may comprise a hydraulic pump and motor assembly. The motor may be coupled to the chain and sprocket connection via a transmission. The at least one guide member may define a track for directing the drum assembly during removal. The lifting apparatus may comprise at least one wheel for engaging with the track of the guide member when the drum assembly is removed. The at least one connector may comprise a container connector.

An embodiment of a method for removing a drum assembly from a mounting location comprises disconnecting the drum assembly from a mounting base, mounting a lifting apparatus to the drum assembly, attaching a guide member to the mounting location, and removing the drum assembly from the mounting location with a lifting device attached to the lifting apparatus, the lifting apparatus engaging with the guide member to limit movement of the drum assembly when lifting.

The method may further comprise a conveyance spooled on the drum assembly. The spooled device may comprise a wireline cable. The method may further comprise disconnecting the drum assembly from a prime mover. The prime mover may comprise a hydraulic pump and motor assembly. The prime mover may comprise an electric motor driving a hydraulic motor. The method may further comprise installing a second drum assembly at the mounting location and connecting the second drum assembly to a prime mover. The method may further comprise disposing a spooled device on the drum assembly, disposing the spooled device within a wellbore, and performing at least one well servicing operation with the spooled device disposed in the wellbore. The at least one guide member may define a track for directing the drum assembly during removal and the lifting apparatus may comprise at least one wheel for engaging with the track when the drum assembly is removed.

The drum assembly advantageously makes the loading and unloading, of a heavy drum assembly quick and safe in harsh conditions, such as offshore conditions and the like. A skid supporting the drum and most of the components related to its functioning in operation may be installed or removed as a single assembly with minimum of apparatus or fasteners to be dismounted.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
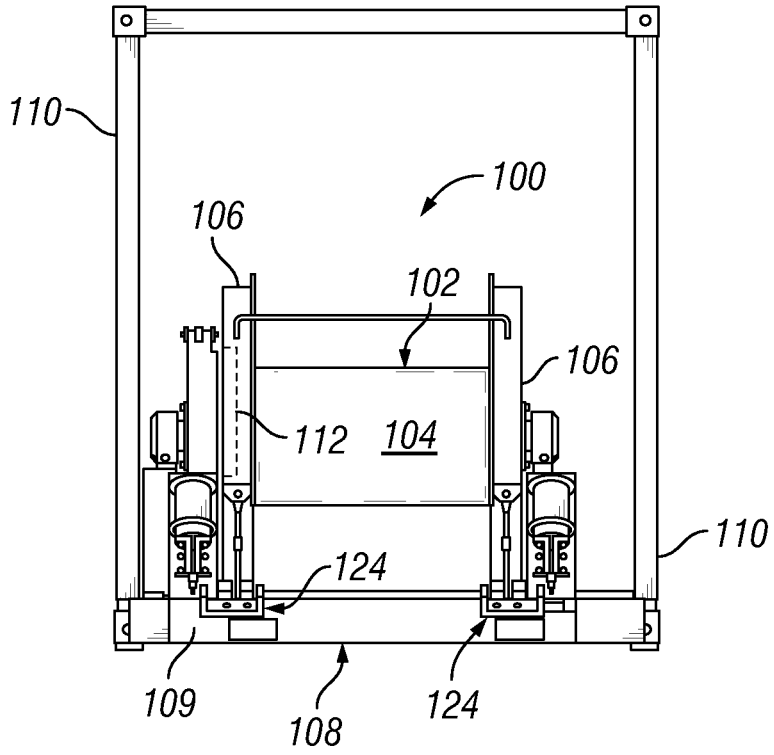
FIGS. 1 through 4 are schematic side views, respectively, of an embodiment of a drum assembly in various stages of installation.

Referring now to FIG. 1, an embodiment of a drum assembly is indicated generally at 100. The drum assembly 100 comprises a drum 102 which is operable to have a spooled device 103 wound thereupon such as, but not limited to, a logging cable, a slickline cable, and coiled tubing. The drum 102 comprises a spool 104 and a pair of opposed flanges 106. The drum 102 is attached to a mounting location, indicated generally at 108 of a mounting base 109, such as an offshore oil rig or the like. The mounting location 108 and mounting base 109 may further comprise a frame assembly 110 disposed above the mounting location 108.

Figure 8:
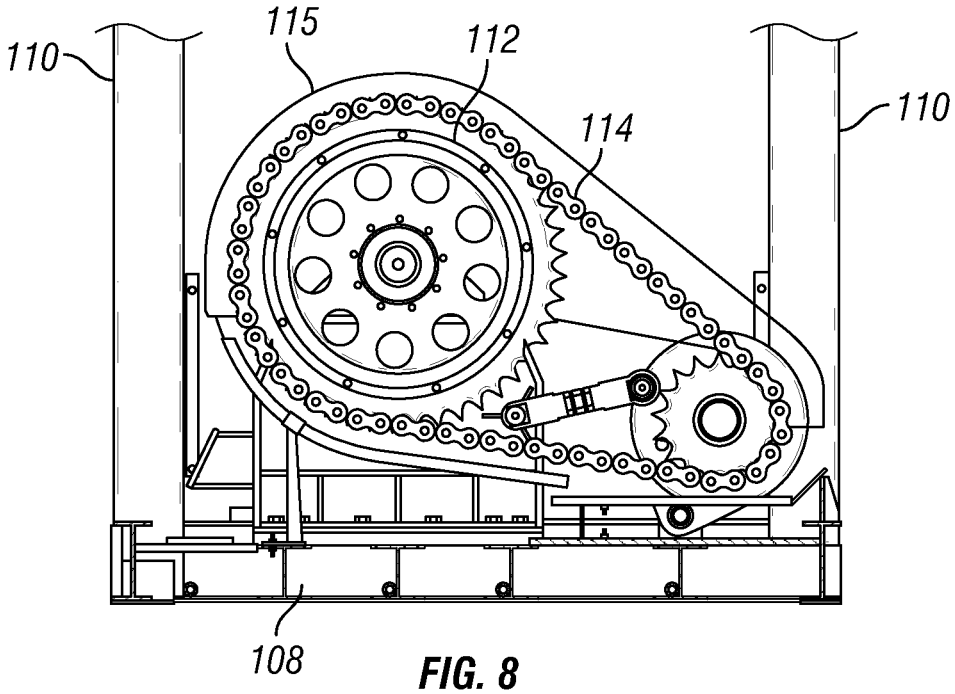
FIG. 8 is a side elevation view of an embodiment of a drum assembly.
Figure 9:
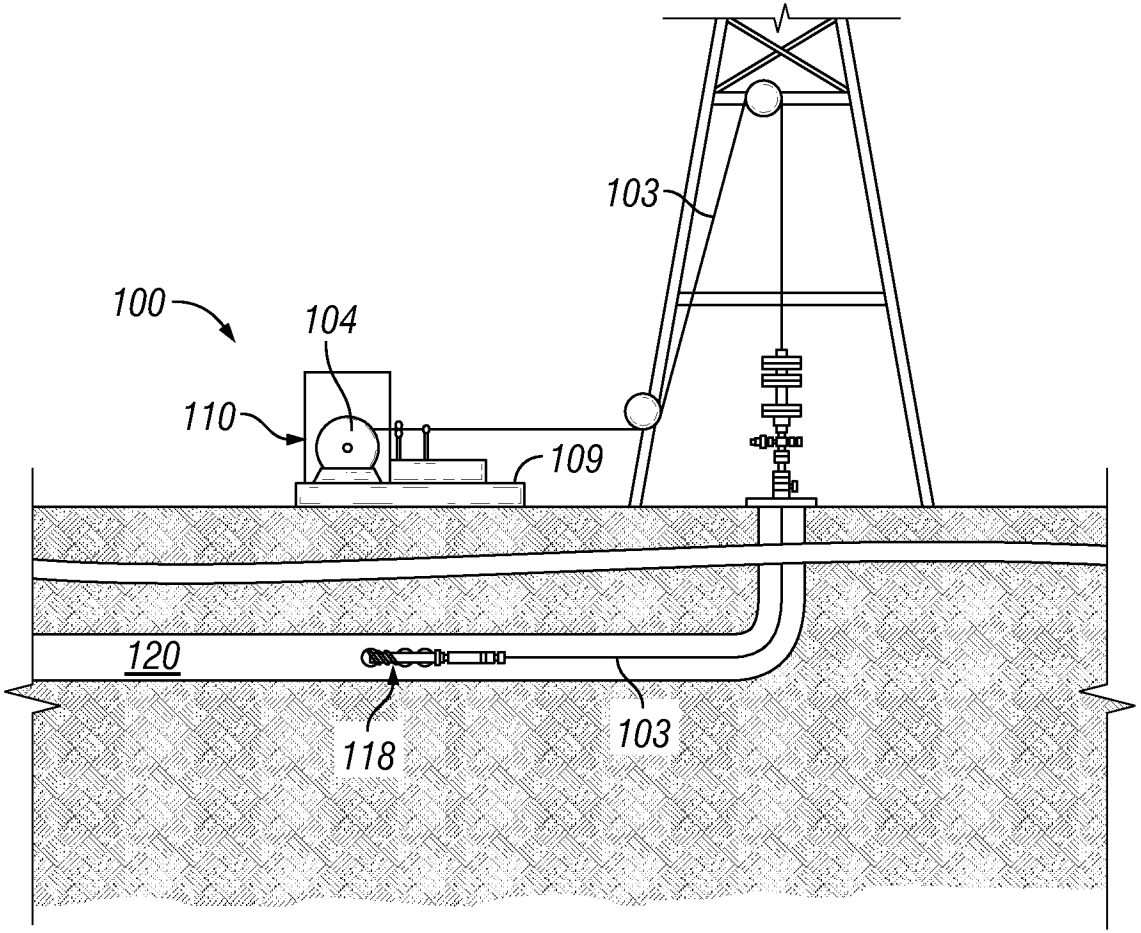
FIG. 9 is a schematic view of an embodiment of a drum assembly adjacent a wellbore.

A sprocket 112 (best seen in FIG. 8) may be mounted on an exterior surface of one of the flanges 106 and is attached, via a chain assembly 114 or the like, to a prime mover 116, such as an internal combustion engine, an electric motor, a hydraulic motor, a combination thereof, or the like through a transmission 117, for rotating the drum 102 during a well servicing operation with the spooled device 103, wherein the spooled device 103 is lowered and raised into a wellbore (not shown). In an embodiment, the prime mover 116 is directly connected to the drum 102 such as by the sprocket 112 and chain assembly 114 or the like. Such a well servicing operation performed by the spooled device 103 may comprise, but is not limited to, a logging operation, conducted by a tool 118 attached to an end of the cable 103 lowered into the wellbore 120, a perforating operation, a completion operation, a stimulation operation, or other well servicing operation or operations, as will be appreciated by those skilled in the art.

Figure 4:
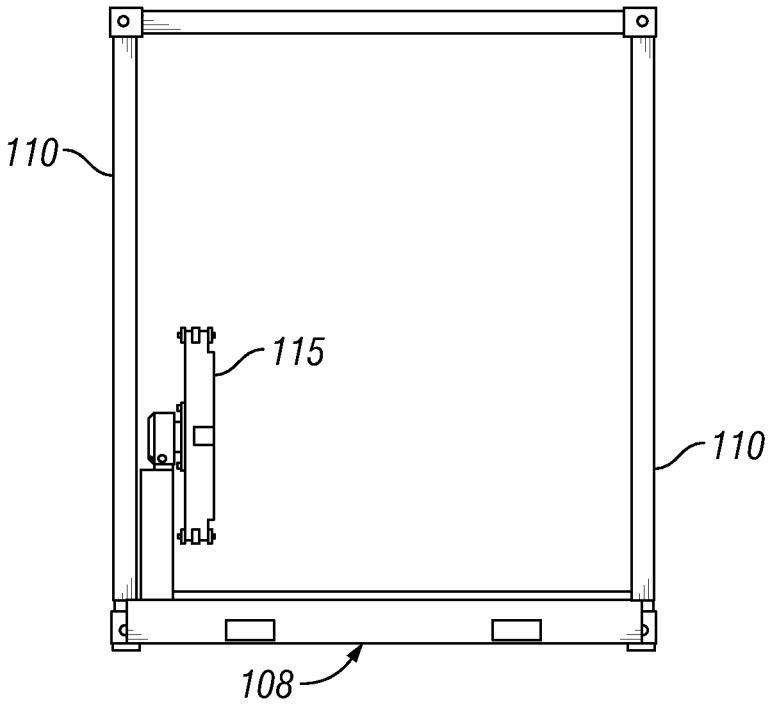

The chain assembly 114 may be a heavy-duty chain or the like having links that engage with spindles on the sprocket 112 and on the transmission 117 of the prime mover 116, thus providing a direct drive of the drum assembly 100 for lowering and raising the spooled device 103 into and out of the wellbore 120. The chain assembly 114 may be protected by a cover 115, best seen in FIG. 4, or the like.

Figure 6:
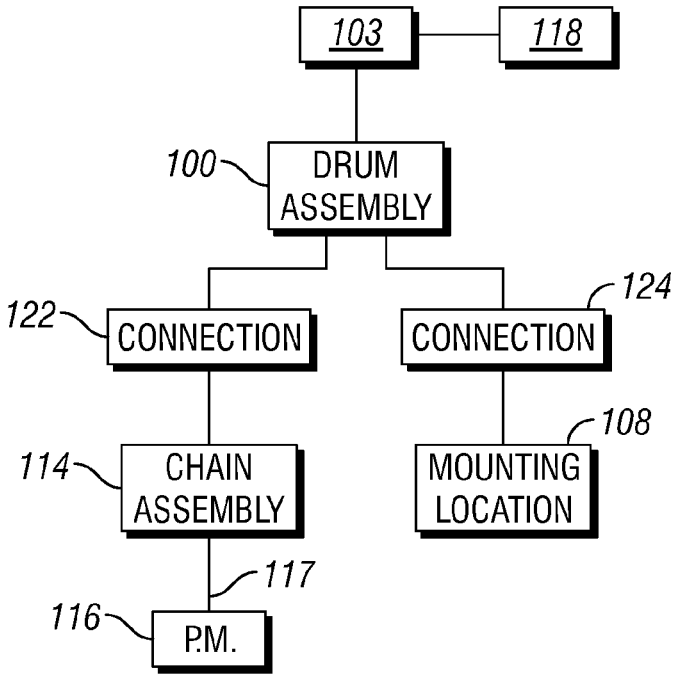
FIG. 6 is a block diagram of components of an embodiment of a drum assembly.
Figure 7:
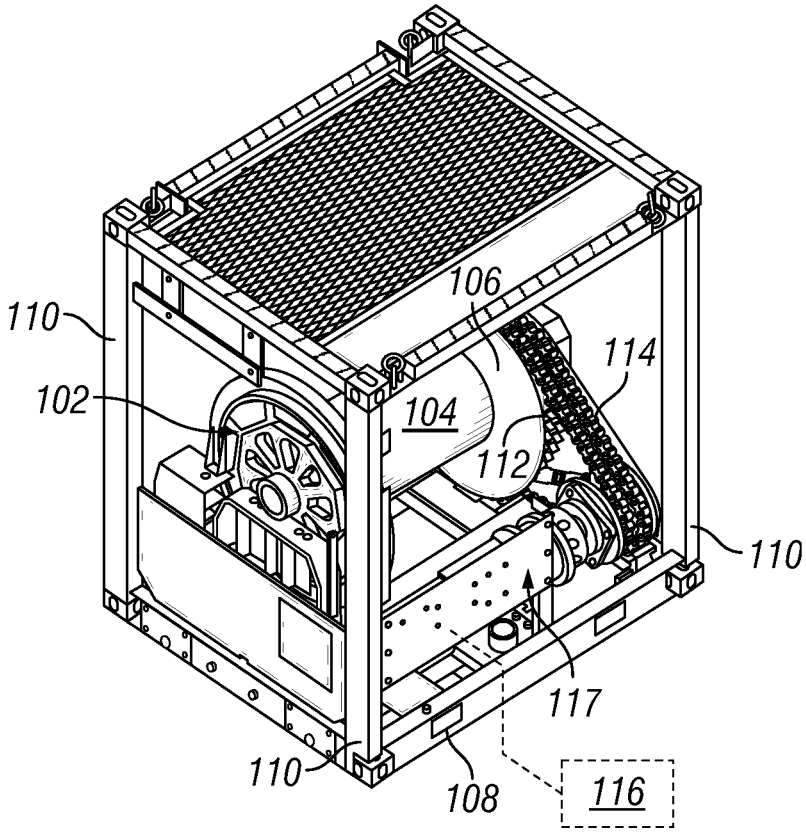
FIG. 7 is a perspective view of an embodiment of a drum assembly.

Referring now to FIG. 6, there is shown a connection 122 between the chain assembly 114 and the drum sprocket 112. The connection 122 may be of a quick connect and disconnect type and may comprise, but is not limited to, a bolted disc, a clutch, a splined shaft, a keyed shaft, an elastic rubber coupling, or similar quick connect and quick disconnect connection. The connection 122 advantageously allows the prime mover 116 and transmission 117 to remain connected to the mounting base 109 when the drum assembly 100 is removed from the mounting location 108. The connection 122 may further be mechanically assisted, such as by a hydraulic actuator, an electric actuator, a hydraulic motor, an electric motor or the like, as will be appreciated by those skilled in the art. The ability for the connection 122 to be quickly connected and disconnected may advantageously reduce the number and complexity of steps required to change the drum assembly 100 during a change-out operation, discussed in more detail below.

Figure 2:
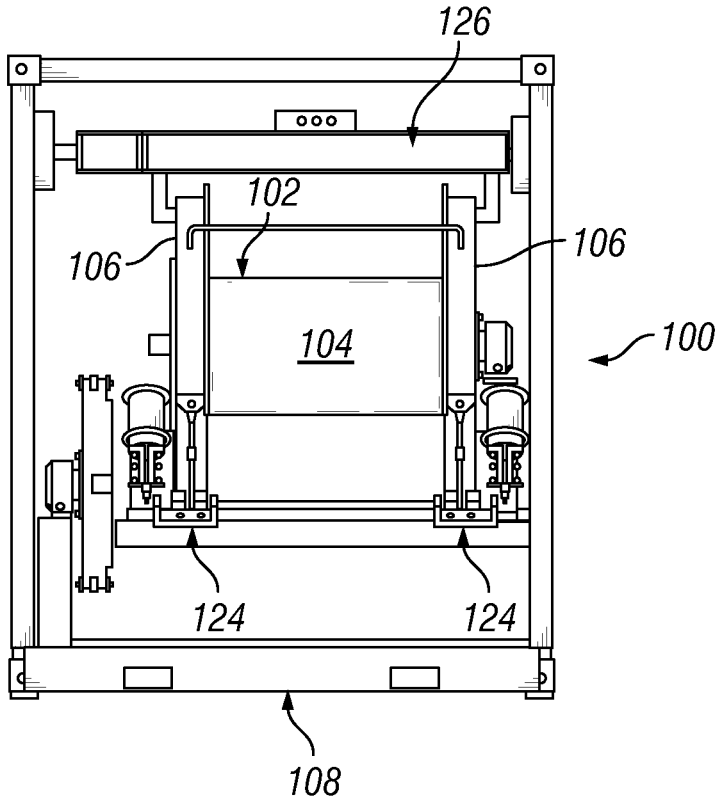
Figure 3:
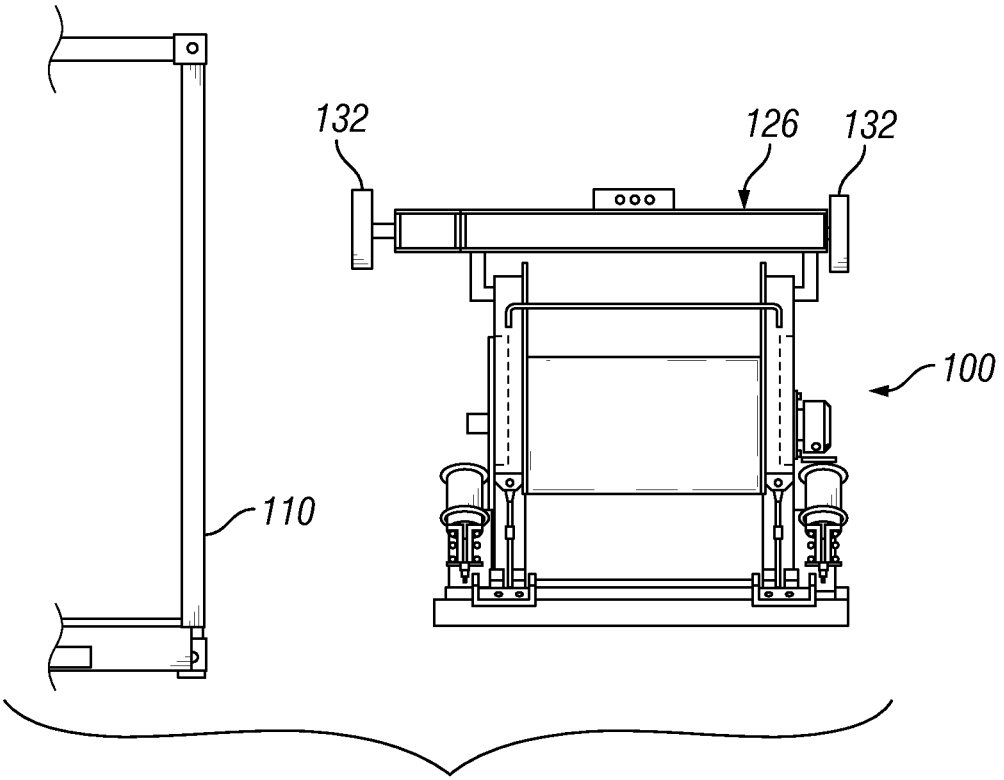

Referring now to FIG. 1, the drum assembly further comprises a plurality of connectors 124 between the drum assembly 100 and the mounting location 108. The connectors 124 may be of a quick connect and quick disconnect type and may comprise, but are not limited to, those connectors utilized for intermodal containers or the like including those manufactured by the Tandemloc Corporation, as will be appreciated by those skilled in the art. A lifting apparatus 126, best seen in FIG. 2, is operable to be attached to the drum 102, such as by a threaded connection to the flanges 106 or by any suitable connection. The lifting apparatus 126 allows a crane (not shown) or similar lifting device to move the drum assembly 100 to and from the mounting location 108 (after the connectors 124 have been disconnected) during a change-out operation, discussed in more detail below. The drum 102 may comprise a predetermined location thereon for mounting the lifting apparatus 126.

Figure 5:
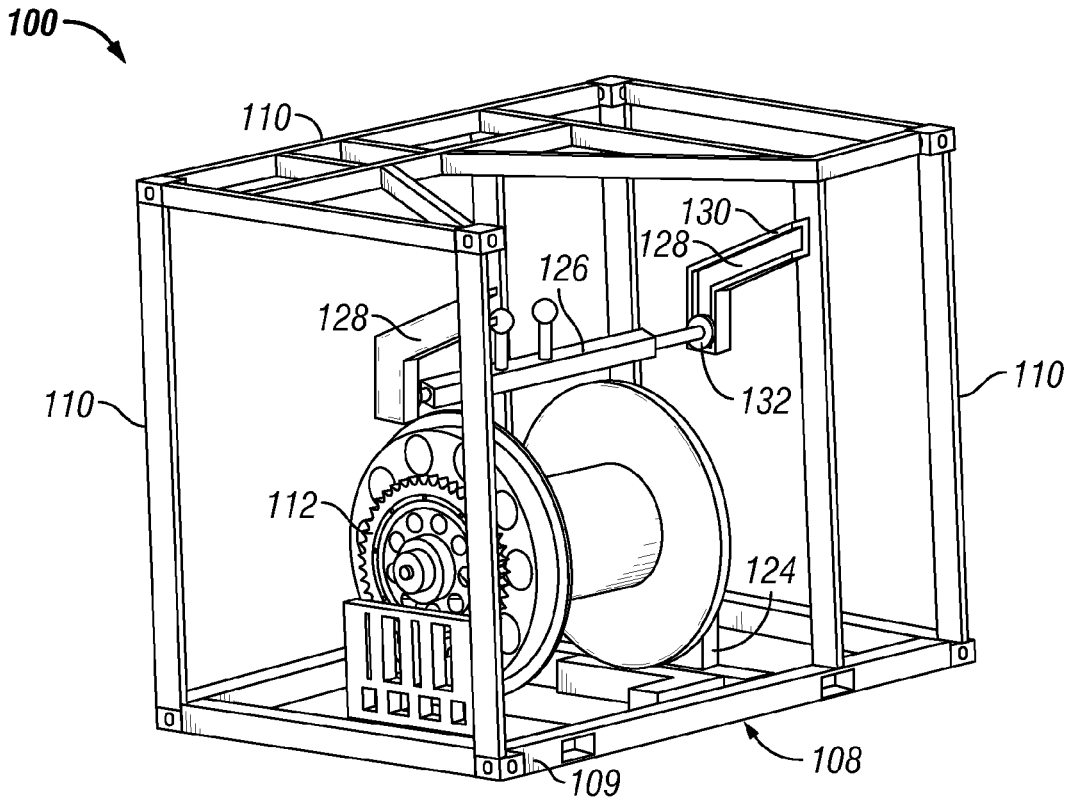
FIG. 5 is a perspective schematic view of an embodiment of a drum assembly.

Referring now to FIG. 5, there is shown at least one guide member 128 adapted to be attached to the frame assembly 110 adjacent the mounting location 108. The guide member 128 engages with the lifting apparatus 126 when the drum assembly 100 is removed from the mounting location 108 to prevent the drum assembly 100 from swinging or otherwise moving until it is fully outside of the frame assembly 110 of the mounting base 109. Such a guide member 128 may be especially advantageous when the drum assembly 100 is mounted on an offshore oil platform, as will be appreciated by those skilled in the art. The guide member 128 may define a track 130 and the lifting apparatus 126 may have wheels 132 for engaging with the track 130 when the drum assembly 100 is removed from the mounting location 108. A portion of the guide member 128 may be substantially vertical or parallel with the frame assembly 110 and a portion of the guide member may be substantially horizontal, as will be appreciated by those skilled in the art.

In a change-out operation, when the drum assembly 100 is to be changed with another drum assembly 100, the prime mover 116 is de-energized, and the guide member or members 128 are attached to the frame assembly 110 and the lifting apparatus 126 is attached to the drum 102. The connection 122 between the chain assembly 114 and the sprocket 112 is disconnected, and the connectors 124 between the drum assembly 100 and the mounting location 108 are disconnected. The lifting apparatus 126 is attached to a winch or the like and lifts the disconnected drum assembly 100 from the mounting location 108. The wheels 132 engage with the guide members 128 and provide a predetermined path for moving the drum assembly 100 away from the frame assembly 110 and mounting location 108. After the drum assembly 100 is clear of the frame assembly 110, it is placed in a preferably secure location, the lifting apparatus 126 is detached from the drum 102 and attached to another drum 100. The other drum assembly 100 is installed utilizing the same above-mentioned steps in a reversed order to attach the drum assembly 100 to the mounting location 108 and the chain assembly 114, as will be appreciated by those skilled in the art.

Embodiments of the drum assembly 100 ease the swap of drums 102, regardless of whether a spooled device 103 such as a logging cable, is disposed on the drum 102 for those assemblies 100 disposed either onshore or offshore. The drum assembly 100 will drastically reduce the time needed to dismount and/or install a drum, such as the drum 102, and therefore will reduce the rig-up time for logging operations, advantageously allowing for increased efficiency at the job site.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values. Accordingly, the protection sought herein is as set forth in the claims below.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

What is claimed is:

1. A system for removably mounting a drum to a winch assembly, comprising:

a drum assembly;

a frame defining at least a portion of a mounting base for the drum;

at least one connector for connecting the drum assembly to the mounting base wherein the at least one connector comprises a container connector;

a lifting apparatus releasably attached to the drum assembly; and at least one guide member releasably attached to the frame and engaging with the lifting apparatus for directing the drum assembly away from the frame when the drum assembly is removed therefrom wherein the drum assembly is releasably coupled to a prime mover wherein the prime mover comprises a motor coupled to the drum assembly via a chain and sprocket connection wherein the motor is coupled to the chain and sprocket connection via a transmission wherein the lifting apparatus comprises at least one wheel for engaging with the track of the guide member when the drum assembly is removed.

2. The system of claim 1 further comprising a conveyance spooled upon the drum.

3. The system of claim 2 wherein the spooled conveyance comprises a wireline cable.

4. The system of claim 2 wherein the spooled conveyance comprises coiled tubing.

5. The system of claim 1 wherein the motor comprises a hydraulic pump and motor assembly.

6. The system of claim 1 wherein the at least one guide member defines a track for directing the drum assembly during removal.

7. A method for removing a drum assembly from a mounting location, comprising:

disconnecting the drum assembly from a mounting base;

mounting a lifting apparatus to the drum assembly;

attaching a guide member to the mounting location; and removing the drum assembly from the mounting location with a lifting device attached to the lifting apparatus, the lifting apparatus engaging with the guide member to limit movement of the drum assembly when lifting wherein the at least one guide member defines a track for directing the drum assembly during removal and wherein the lifting apparatus comprises at least one wheel for engaging with the track when the drum assembly is removed.

8. The method of claim 7 further comprising a conveyance spooled on the drum assembly.

9. The method of claim 8 wherein the spooled device comprises a wireline cable.

10. The method of claim 7 wherein further comprising disconnecting the drum assembly from a prime mover.

11. The method of claim 10 wherein the prime mover comprises a hydraulic pump and motor assembly.

12. The system of claim 10 wherein the prime mover comprises an electric motor driving a hydraulic motor.

13. The method of claim 7 further comprising installing a second drum assembly at the mounting location and connecting the second drum assembly to a prime mover.

14. The method of claim 13 further comprising disposing a spooled device on the drum assembly, disposing the spooled device within a wellbore, and performing at least one well servicing operation with the spooled device disposed in the wellbore.

15. A system for removably mounting a drum to a winch assembly, comprising:

a drum assembly;

a frame defining at least a portion of a mounting base for the drum;

at least one connector for connecting the drum assembly to the mounting base;

a lifting apparatus releasably attached to the drum assembly; and at least one guide member releasably attached to the frame and engaging with the lifting apparatus for directing the drum assembly away from the frame when the drum assembly is removed therefrom, the drum assembly releasably coupled to a prime mover comprising a motor coupled to the drum assembly via a chain and sprocket connection, wherein the motor is coupled to the chain and sprocket connection via a transmission, and further wherein the lifting apparatus comprises at least one wheel for engaging with the track of the guide member when the drum assembly is removed.

* * * * *